US005167514A

United States Patent [19]

Suzuki et al.

[11] Patent Number: 5,167,514

[45] Date of Patent: Dec. 1, 1992

[54] PLUG AND RECEPTACLE OF A MICROSTRIP LINE CONNECTOR

[75] Inventors: Takao Suzuki; Hiroshi Uesugi; Yoshiharu Tamura; Naoki Hirasawa; Hirofumi Matsumoto, all of Tokyo, Japan

[73] Assignees: Japan Aviation Electronics Industry Limited; NEC Corporation, both of Tokyo, Japan

[21] Appl. No.: 788,182

[22] Filed: Nov. 5, 1991

[30] Foreign Application Priority Data

Nov. 13, 1990 [JP] Japan ..... 2-118672[U]

[51] Int. Cl.[5] ..... H01R 13/648

[52] U.S. Cl. ..... 439/108; 439/607

[58] Field of Search ..... 439/63, 101, 108, 581, 439/607

[56] References Cited

U.S. PATENT DOCUMENTS

| | | | |
|---|---|---|---|
| 3,871,728 | 3/1975 | Goodman | 339/14 R |
| 4,659,156 | 4/1987 | Johnescu et al. | 439/581 |
| 4,881,905 | 11/1989 | Demler et al. | 439/79 |
| 5,073,130 | 12/1991 | Nakamura | 439/607 |

FOREIGN PATENT DOCUMENTS

| | | |
|---|---|---|
| 0370833 | 5/1990 | European Pat. Off. . |
| 88/04484 | 6/1988 | PCT Int'l Appl. . |

*Primary Examiner*—Neil Abrams

*Attorney, Agent, or Firm*—Pollock, VandeSande & Priddy

[57] ABSTRACT

In a plug and a receptacle of a microstrip line connector, the plug has a rectangular parallelpipedic insulating support block, a signal contact projecting upward from the center of the insulating support block and a pair of L-angle brackets projecting out upward from both ends of the insulating support block, the pair of brackets being connected to opposite ends of a coupling plate portion provided along the side wall surface of the insulating support block. The coupling plate portion has at the center of its lower marginal edge a recess formed astride a signal conductor of a microstrip line provided on a printed circuit board. The receptacle is made up of a rectangular parallelpipedic insulating housing having three contact housing rooms defined by two partition walls, a signal socket contact housed in the central contact housing room, a U-shaped ground socket contact having two contact portions housed in the side contact housing rooms, and a shield cover mounted on the insulating housing in a manner to cover almost all over its back and hold its top and bottom panel portions. The insulating housing has a contact introducing hole in its front panel portion centrally thereof and communicating with the central contact housing room, for receiving the signal contact of the mating plug. The insulating housing has slots in its side panel portions in the front-to-back direction and communicating with the side contact housing rooms, for receiving opposed edges of the pair of L-angle brackets.

6 Claims, 5 Drawing Sheets

PLUG AND RECEPTACLE OF A MICROSTRIP LINE CONNECTOR

BACKGROUND OF THE INVENTION

The present invention relates to a plug and a receptacle of a connector by which microstrip lines formed on separate printed circuit boards to constitute high-frequency circuits can electrically be connected to and, if necessary, disconnected from each other.

In circuits handling signals of an ultrahigh frequency band a circuit pattern which is formed on a printed circuit board has a microstrip line structure on account of impedance matching. Where it is necessary that circuits formed by microstrip lines be separately mounted on a plurality of printed circuit boards, it is customary in the art to mount coaxial connectors to the microstrip lines and interconnect the coaxial connectors by coaxial cables to interconnect the microstrip lines of the separate printed circuit boards.

Since the coaxial connector is bulky as well as expensive, a large space is required for interconnecting the printed circuit boards. This introduces difficulty in miniaturization of the entire device. In view of this, it is considered to employ a connector which permits electrically direct connection of printed circuit boards, but the connector of this type has a high impedance, which mismatches with the microstrip line. If such a connector is used with ultrahigh frequency circuits, then a reflection occurs in the connector, resulting in deterioration of the signal quality. In the case of directly interconnecting printed circuit boards, particularly close tolerances are needed for positioning them relative to each other, so that their connection may sometimes become difficult. To avoid this, it is necessary to increase the widths and lengths of signal contacts and ground contacts of the connector, but this increases the inductance of the connector, and hence augments the impedance mismatching.

SUMMARY OF THE INVENTION

It is therefore an object of the present invention to provide a plug and a receptacle of a connector for a microstrip line which are able to directly interconnect printed circuit boards while maintaining impedance matching with the microstrip line.

The plug of a connector for a microstrip line according to the present invention is made up of: a ground contact member provided with a coupling plate/disposed astride a signal conductor forming a strip line on a printed circuit board and having a recess formed in a manner to avoid contact with the signal conductor, and a pair of contact pieces projected from opposite ends of the coupling plate in a direction vertical to the surface of an insulating plate of the printed circuit board where the strip line is formed; a signal contact member provided with a contact piece disposed just midway between the pair of contact pieces of the ground contact member and held in contact with the signal conductor of the strip line, and a contact bent at right angles to the contact piece and projected therefrom in parallel to the contact pieces of the ground contact member; and an insulating support block electrically isolating but supporting the signal contact member and the ground contact member as one piece.

The receptacle of the present invention, for receiving the plug, is made up of: a substantially rectangular parallelpipedic insulating housing provided with both side panels each having cut therein a groove for receiving one of the pair of contact pieces of the ground contact member of the plug, a front panel having made therein a contact receiving hole substantially at the center of a line joining the openings of the grooves, and a top panel formed as a unitary structure with both side panels and the front panel; a signal socket contact including contact pieces means housed in the insulating housing at the axial position of the contact receiving hole for elastic contact with the signal contact of the plug, and an extended piece extended from the base of the contact piece means along the top panel of the housing and having a predetermined area; a ground socket contact housed in the insulating housing and exposed in the grooves cut in the side panels for contact with the pair of contact pieces of the ground contact member of the plug; and a shield cover which is electrically connected to the ground socket contact, surrounds and shields the ground socket contact and the signal socket contact, forms an electrostatic capacitance between the extended piece of the signal socket contact and the signal socket contact and is connected to a ground conductor of the microstrip line.

The plug and the receptacle according to the present invention are electrically and mechanically connected to strip lines formed on printed circuit boards, respectively, and by putting the plug in the receptacle, the strip lines formed on the separate printed circuit boards can be interconnected directly. In addition, the receptacle includes the piece extended from the signal socket contact in parallel to the shield cover, by which an appropriate electrostatic capacitance can be formed between the signal socket contact and the shield cover, and by a suitable selection of the electrostatic capacitance, the impedance between the signal socket contact and the shield cover can be set to a proper value. Thus, the impedance of the connector can be matched with the impedance of the microstrip line; namely, impedance matching can be achieved. Accordingly, the printed circuit boards can be directly interconnected and the impedance of their connecting portion can be matched with the impedance of the microstrip line.

DESCRIPTION OF THE PREFERRED EMBODIMENTS

Figure 1:
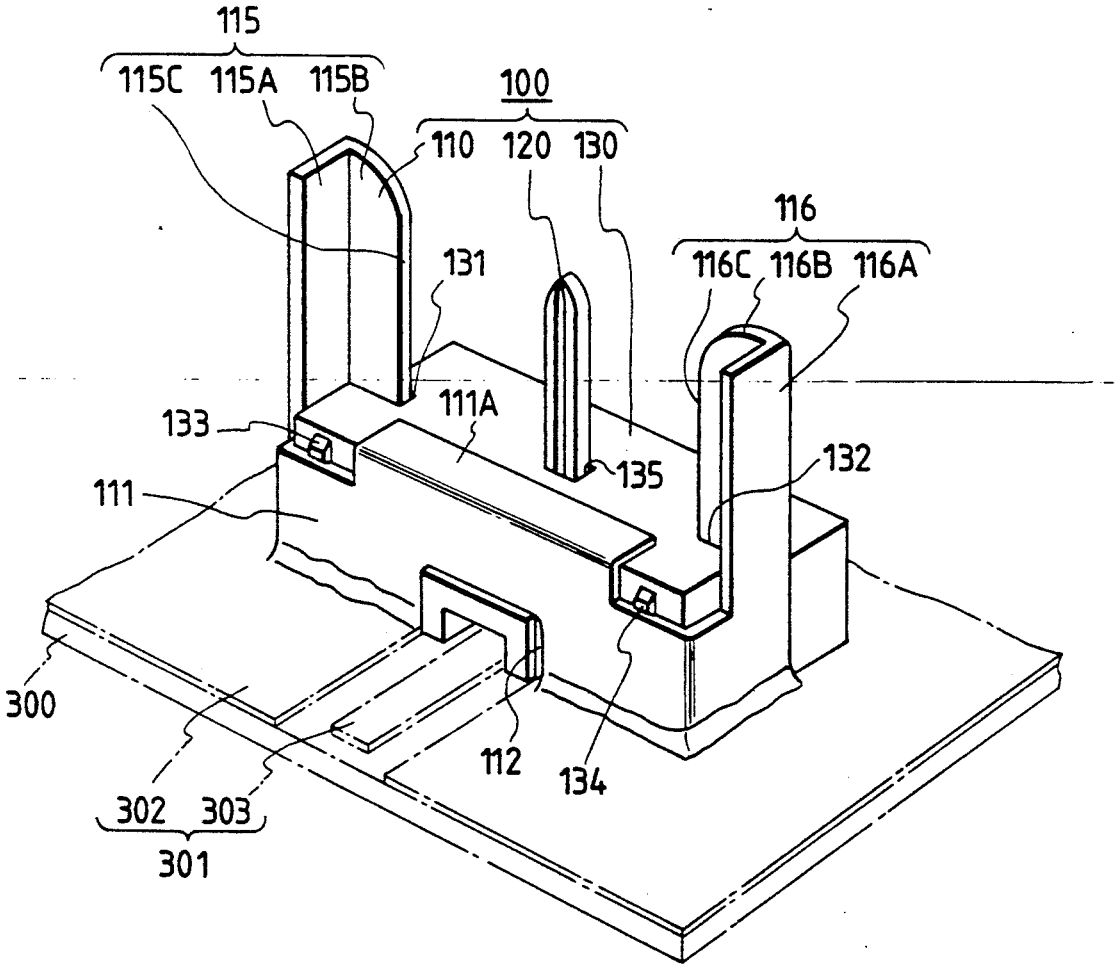
FIG. 1 is a perspective view of the plug according to the present invention.

In FIG. 1, reference numeral 100 indicates generally a plug of a connector for a microstrip line in accordance with an embodiment of the present invention.

The plug 100 comprises a ground contact member 110, a signal contact member 120 and an insulating support block 130. FIG. 1 shows the plug 100 on the assumption that it is mounted on a printed circuit board 300. The printed circuit board 300 in this example is shown to have formed thereon an open planar microstrip line 301. That is, the microstrip line 301 is composed of a ground conductor 302 and a signal conductor 303 formed in the same plane.

The ground contact member 110 is electrically connected to the ground conductor 302 forming the microstrip line 301 and is mounted on the printed circuit board 300. A portion of the ground contact member 110 making contact with the ground conductor 302 will hereinafter be referred to as a coupling plate portion 111. The ground contact member 110 is obtained by punching out a sheet metal into a desired pattern and bending it as required. The ground contact member 110 includes the coupling plate portion 111 which covers one longer side surface of the substantially rectangular parallelpipedic insulating support block 130 and has its two end portions bent in a manner to hold therebetween the insulating support block 130. On its opposite end faces (i.e. shorter side surfaces) L-angle brackets 115 and 116 are coupled at their lower ends to both ends of the coupling plate portion 111 and extend upwardly above the top of the insulating support block 130 on its two end faces. The L-angle brackets 115 and 116 have their plate portions 115A and 116A held in contact with the shorter side surfaces of the insulating support block 130, and plate portions 115B and 116B bent at right angles to the plate portions 115A and 116A, respectively, are substantially flush with each other and are received in grooves 131 and 132 cut in the shorter side surfaces of the insulating support block 130. The coupling plate portion 111 has a recess 112 cut in its lower marginal edge centrally thereof so that it remains out of contact with the signal conductor 303 forming the microstrip line 301.

Figure 2:
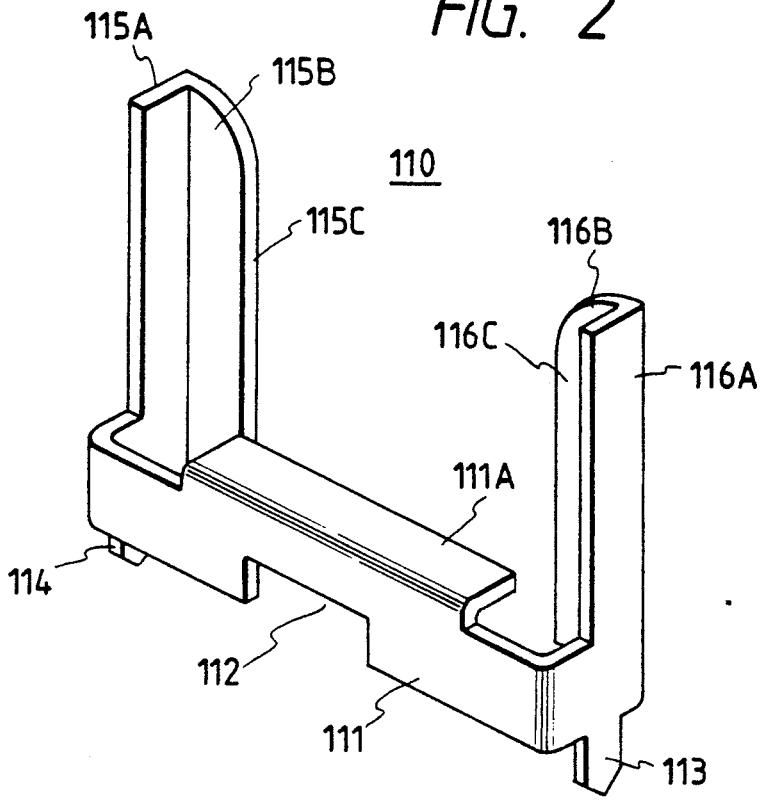
FIG. 2 is a perspective view of a ground contact member for use in the plug of the present invention.

The coupling plate portion 111 has its upper central marginal portion bent at right angles to form a press piece 111A. The coupling plate portion 111 has downward projecting pieces 113 and 114 extending from its two ends in the direction opposite from the L-angle brackets 115 and 116 (FIG. 2). The projecting pieces 113 and 114 are pressed into holes made in the printed circuit board 300 so that the plug 100 is mechanically planted thereon. The coupling plate portion 111 is soldered along its lower marginal edge to the ground conductor 302 of the microstrip line 301, and hence is fixed thereto electrically and mechanically. The plate portions 115B and 116B of the L-angle brackets 115 and 116 form contact piece portions and their opposed edges 115C and 116C make contact with a ground socket contact of a receptacle 200 described later.

The upper marginal portion of the rectangular parallelpipedic insulating support 130 is locked by the press piece 111A of the coupling plate portion 111. The contact piece portions 115B and 116B are received in the grooves 131 and 132 cut in the end faces of the insulating support block 130, and lugs 133 and 134 engage marginal edges of the coupling portion 111 to prevent it from falling off. The insulating support block 130 has a centrally-disposed through hole 135 extending therethrough vertically, which receives and firmly supports the signal contact member 120.

Figure 3:
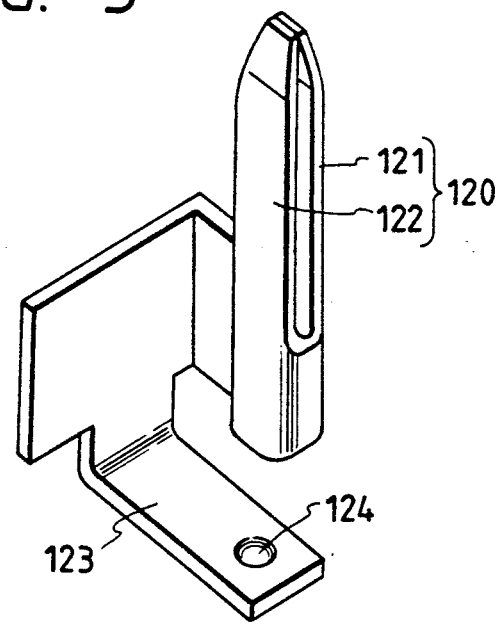
FIG. 3 is a perspective view of a signal contact member for use in the plug of the present invention.
Figure 4:
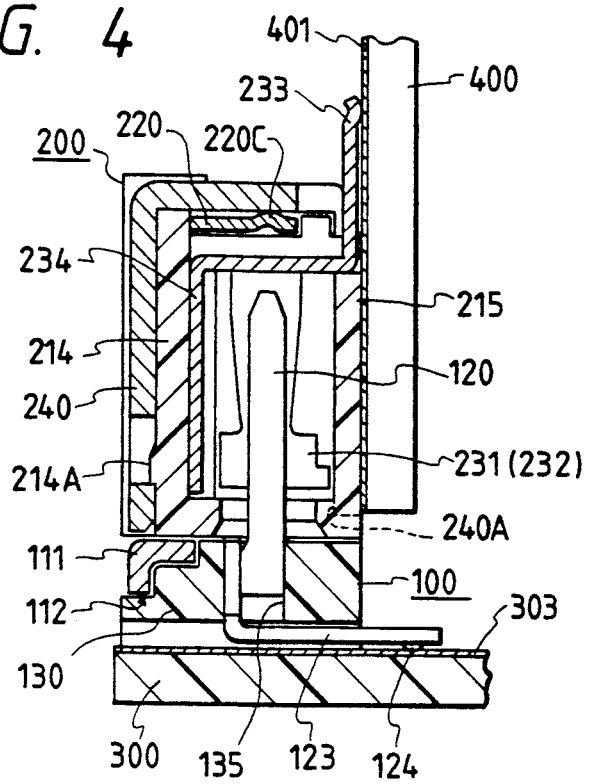
FIG. 4 is a vertical sectional view for explaining how to engage the plug and the receptacle according to the present invention.

The signal contact member 120 is also obtained by punching out a sheet metal into a desired shape and bending it. FIG. 3 shows its structure on an enlarged scale. The signal contact member 120 is formed by a pair of opposed pieces 121 and 122 coupled together at their base ends. The signal contact member 120 has an L-shaped terminal 123 extending from the coupling portion of the opposed pieces 121 and 122, and as depicted in FIG. 4 which shows the state of connection between the plug 100 and the receptacle 200, the terminal 123 projects out of the plug structure through a channel 137 formed in the bottom of the insulating support block 130 at right angles to a line joining the pair of L-angle brackets 115 and 116. The projecting end of the terminal 123 makes contact with the signal conductor 303 of the microstrip line 301 formed on the printed circuit board 300 as shown in FIG. 4. The projecting end of the terminal 123 has a lug 124 for contact with the signal conductor 303 at one point.

Next, a description will be given of the construction of the receptacle 200.

Figure 5:
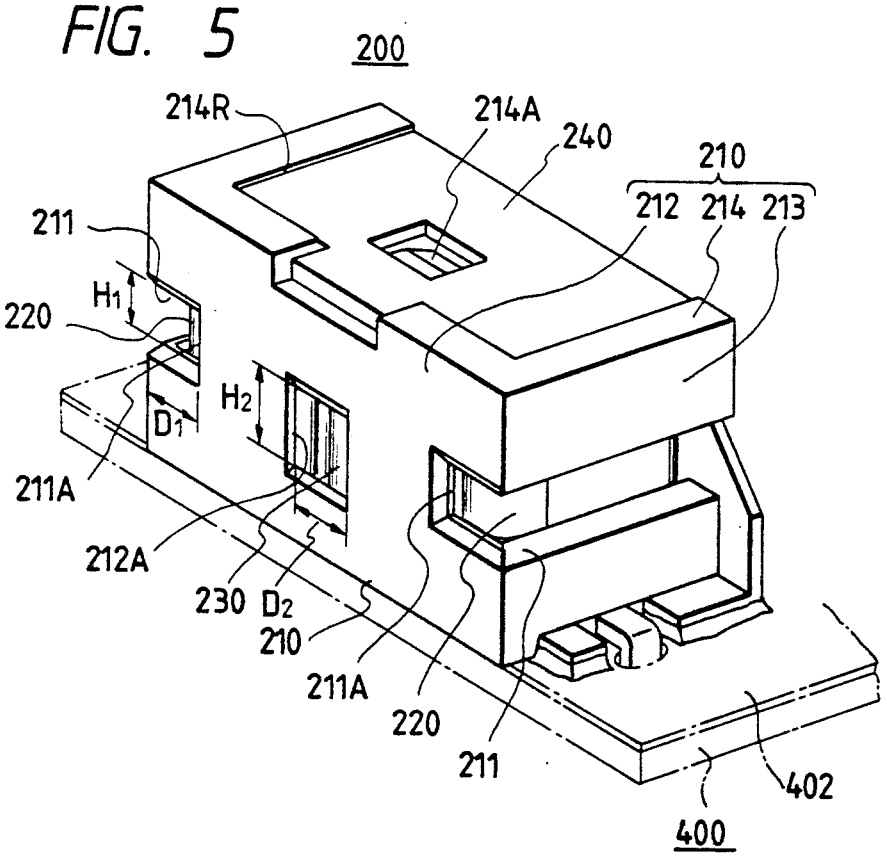
FIG. 5 is a perspective view of the receptacle according to the present invention.

As depicted in FIG. 5, the receptacle 200 is made up of a substantially rectangular parallelpipedic insulating housing 210, a ground socket contact 220 housed therein and exposed through slots 211 cut in both sides of the housing 210, a signal socket contact 230 housed in the insulating housing 210, and a shield cover 240.

Figure 6:
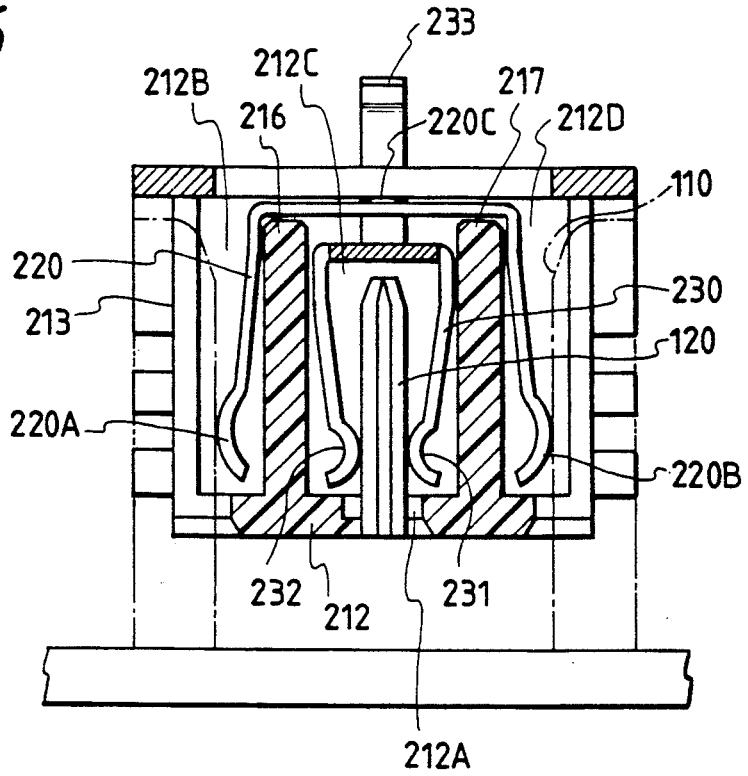
FIG. 6 is a horizontal sectional view for explaining how to engage the plug and receptacle according to the present invention.

The insulating housing 210 has a front panel 212, side panels 213, a top panel 214 (FIG. 5) and a bottom panel 215 (FIG. 4). As depicted in FIG. 6, the inside of the housing 210 is essentially separated into three contact housing rooms 212B, 212C and 212D by two parallel partition walls 216 and 217 extending rearwardly from the front panel 212. In the middle contact housing room 212C the signal socket contact 230 is housed from behind the housing 210, and in the two side contact housing rooms 212B and 212D contact portions 220A and 220B, coupled at their rear ends together to form the ground socket contact 220 (FIG. 8), are housed from behind the housing 210. The two side panels 213 of the housing 210 have the slots 211 extending in the front-to-back direction and communicating with the contact housing rooms 212B and 212D. The slots 211 have a desired height H1 so that the plate portions 115B and 116B of the ground contact member 110 of the mating plug 100, when inserted thereinto, may slightly be shifted lengthwise thereof. The slots 211 are extended as well to the front panel 212 to form recesses 211A, whose depths D1 are suitably selected so that their plate portions 115B and 116B may slightly be shifted widthwise thereof. In the top of the top panel 214 there is a concavity 214R for receiving a top panel 240B of the shield cover 240 described later.

In the front panel 212 intermediate between the recesses 211A, there is a contact introducing hole 212A which communicates with the contact housing room 212C and has its center aligned with the axis of the signal socket contact 230 received in the contact housing room 212C. The height H2 and the width D2 of the contact introducing hole 212A are chosen so that the plug 100 may be shifted vertically and horizontally relative to the receptacle 200 when the signal contact 120 of the plug 100 has been inserted in the contact introducing hole 212A.

Figure 7:
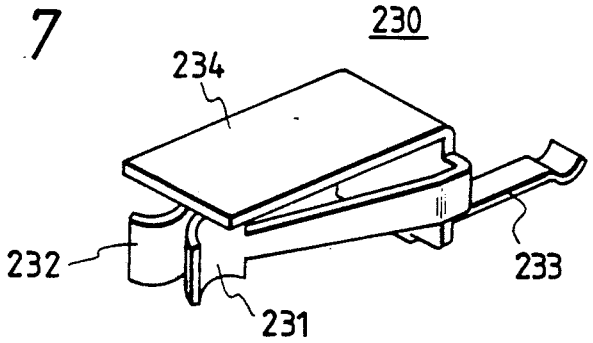
FIG. 7 is a perspective view of a signal socket contact for use in the plug according to the present invention.

The signal socket contact 230 is produced by punching out a springy sheet metal into a desired shape and bending it. As shown in FIGS. 6 and 7, the signal socket contact 230 has a pair of opposed contact pieces 231 and 232 coupled together at their bases, a signal terminal 233 extending rearwardly from their coupling portion, and an extended piece 234 bent forwardly from the coupling portion and having a desired area. As depicted in FIG. 4, the extended piece 234 is opposite the shield cover 240 across the top panel 214 of the insulating housing 210 and adds an electrostatic capacitance to the ground conductor, causing the impedances of the signal contact member 120 and the signal socket contact 230 to match with the impedances of the microstrip lines.

The widths of the contact pieces 231 and 232 are about the same as the height H2 of the contact introducing hole 212A. The contact pieces 231 and 232 are disposed symmetrically with respect to the axis of the contact introducing hole 212A and make elastic contact with the signal contact member 120 of the plug 100 inserted therebetween, thus interconnecting the signal lines of the plug 100 and the receptacle 200. The signal terminal 233 of the signal socket contact 230 is extended rearwardly of the insulating housing 210 and is held in contact with a signal conductor 401 of the microstrip line formed on a printed circuit board 400 as shown in FIG. 4.

Figure 8:
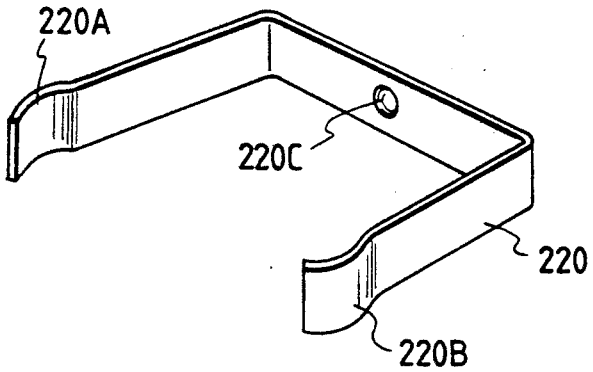
FIG. 8 is a perspective view of a ground socket contact for use in the plug of the present invention.

In the contact housing rooms 212B and 212D formed in the insulating housing 210 there are housed contact portions 220A and 220B of the U-shaped ground socket contact 220. The ground socket contact 220 has a width substantially equal to or greater than the aforementioned height H1 of the slot 211 and, as shown in FIGS. 6 and 8, it is bent into U-shape, the free end portions of its two arms forming the contact portions 220A and 220B for contact with the ground contact member 110 of the plug 100. The outside surfaces of the contact portions 220A and 220B are exposed through the slots 211 cut in the side panels 213 of the insulating housing 210. When the plug 100 is put in the receptacle 200, the contact piece portions 115A and 116A of the ground contact member 110 of the plug 100 are inserted into the slots 211 and make contact with the contact portions 220A and 220B of the ground contact 220. The contact pieces 231 and 232 of the signal socket contact 230 and the contact portions 220A and 220B of the ground socket contact 220 are formed long enough to ensure elastic contact between the plug 100 and the receptacle 200, even if the former is somewhat displaced relative to the latter.

The U-shaped contact 220 has on its base portion an outward protrusion 220C, which is contacted with the shield cover 240 as shown in FIG. 4. Consequently, the ground socket contact 220 is connected to a ground conductor 402 (FIG. 5) of the printed circuit board 400 via the shield cover 240.

Figure 9:
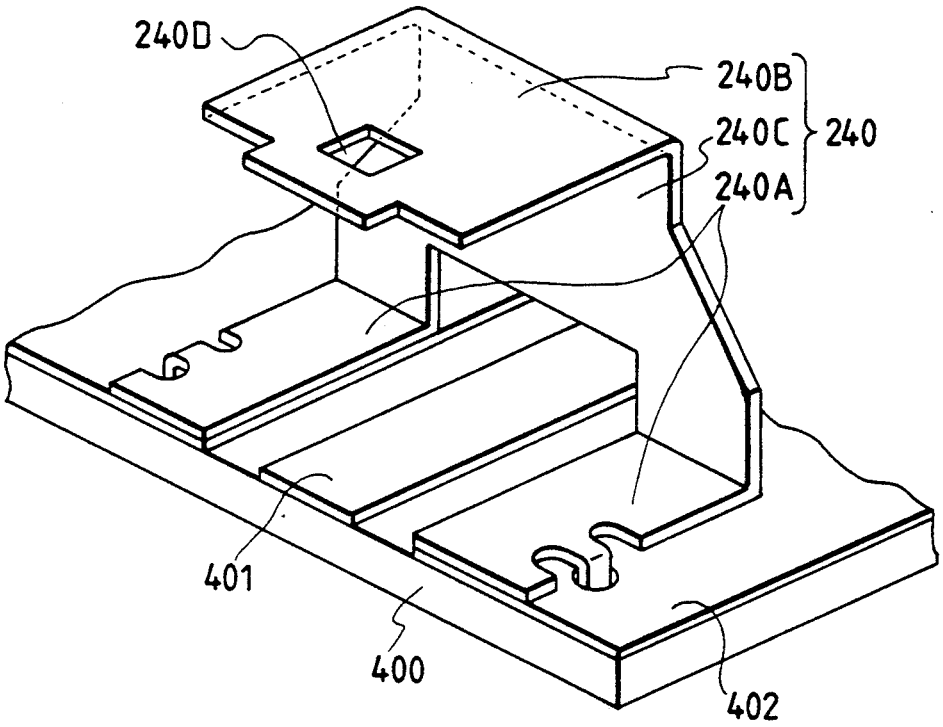
FIG. 9 is a perspective view of a shield cover for use in the plug of the present invention.
Figure 10:
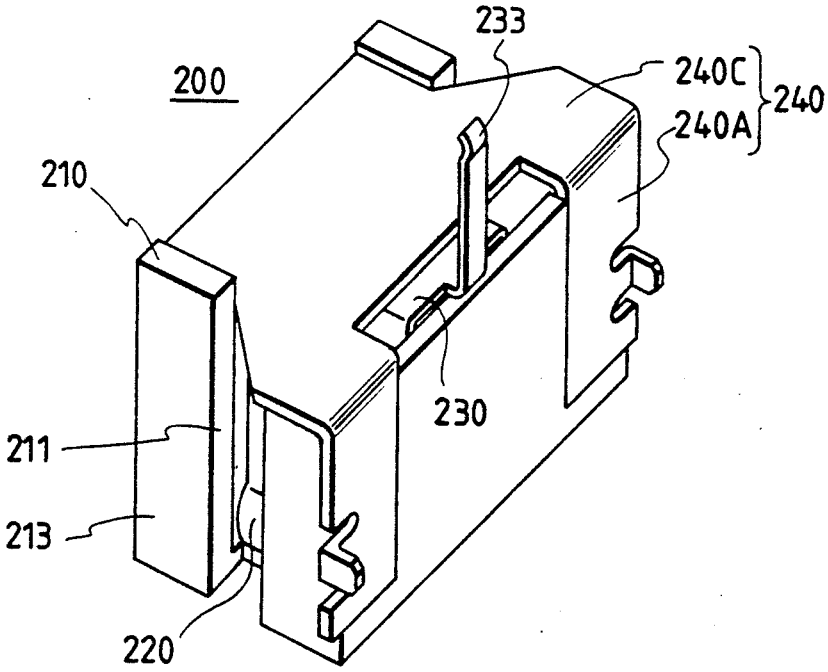
FIG. 10 is a perspective view of the receptacle as viewed from the back thereof.

The shield cover 240 is produced by bending a metal plate punched out into the form of a fork, and as shown in FIGS. 9 and 10, it is formed by two terminal portions 240A which are fixed in contact with the ground conductor 402 on both sides of the signal conductor 401 on the printed circuit board 400, a top panel portion 240B which is placed on the top of the insulating housing 210, and a rear panel portion 240C which covers the back of the insulating housing 210.

The top panel portion 240B is fitted in the concavity 214R made in the top panel 214 of the insulating housing 210 as mentioned previously. The top panel portion 240B faces the extended piece 234 of the signal socket contact 230 received in the contact housing room 212C, forming an electrostatic capacitance between the signal socket contact 230 and the ground. The top panel portion 240B and the terminal portions 240A hold therebetween the insulating housing 210, and a hole 240D made in the top panel portion 240B is engaged with a lug 214A protrusively provided on the top panel 214 of the insulating housing 210 (FIGS. 4 and 5). Thus, the shield cover 240 and the insulating housing 210 are formed as a unitary structure with each other.

As described above, according to the present invention, the plug 100 and the receptacle 200 are electrically connected to the microstrip lines formed on the separate printed circuit boards 300 and 400 and packaged thereto, and by putting the plug 100 into the receptacle 200, the microstrip lines formed on the printed circuit boards 300 and 400 can be interconnected electrically.

In this instance, since the receptacle 200 has a construction in which a proper electrostatic capacitance is formed between the ground and the signal socket contact 230 having its extended piece 234 disposed opposite the top panel portion 240B of the shield cover 240 across the top panel of the insulating housing 210 and the impedance between the signal socket contact 230 and the shield cover 240 can be set to an appropriate value, the impedance in the connecting portion of the plug 100 and the receptacle 200 can be matched with the characteristic impedance of each microstrip line. Hence, the microstrip lines formed on the printed circuit boards 300 and 400 can be connected to each other in the impedance matched state and they can be disconnected as required. Moreover, the plug and the receptacle can be manufactured at low costs as compared with coaxial connectors, since their parts can be produced by thin plate working and molding of resin.

While the microstrip lines have been described above to be the open planar type, the present invention is also applicable to the case of employing a microstrip line of the type having a ground conductor on the back of an insulating plate and a signal conductor on the surface thereof.

It will be apparent that many modifications and variations may be effected without departing from the scope of the novel concepts of the present invention.

What is claimed is:

1. A plug of a microstrip line connector comprising:

A) a ground contact member including a coupling plate portion disposed astride a signal conductor forming a microstrip line and having a recess formed to avoid its contact with said signal conductor, and a pair of contact piece means projecting out from both ends of said coupling plate portion in a direction substantially perpendicular to the surface of an insulating plate on which said strip line is formed;

B) a signal contact member for engaging the microstrip line and including a terminal disposed midway between said pair of contact piece means of said ground contact member, and a signal contact piece bent from said terminal at right angles thereto and extending in parallel to said pair of contact piece means; and C) an insulating support block for supporting said signal contact member and said ground contact member as a unitary structure while insulating them from each other with the ground and signal contact pieces positioned for engagement with terminals of a mating connector.

2. The plug of claim 1 wherein said insulating support block is a substantially rectangular parallelpipedic member, wherein said coupling plate portion of said ground contact member is a plate-like member covering substantially the entire area of one side surface of said insulating support block and holding said insulating support block between its both ends, and wherein said pair of contact piece means is formed by a pair of L-angle brackets including first plate portions coupled together through said coupling plate portion and having faces opposed to each other and second plate portions bent from said first plate portions at right angles thereto toward each other and having their lower end portions received in grooves cut in both sides of said insulating support block, edges of said second plate portions being contacted with a ground contact of the mating plug.

3. The plug of claim 1 or 2 wherein said coupling plate portion has the central portion of its lower marginal edge removed to form said recess and has its upper marginal portion bent to form a press piece for engagement with said insulating support block.

4. A receptacle of a microstrip line connector which receives a plug having a pair of contact piece means of a ground contact member and a signal contact disposed midway between said pair of contact piece means and which is mounted on a microstrip printed circuit board, said receptacle comprising:

A) a substantially rectangular parallelpipedic insulating housing having formed therein contact housing room means and made up of side panel portions having slots made therein in communication with said contact housing room means for receiving said pair of contact piece means of said ground contact member of said plug, a front panel portion having a contact introducing hole made therein substantially centrally thereof in communication with said contact housing room means, and a top panel portion formed as a unitary structure with said front panel portion and said side panel portions;

B) signal socket contact means including contact piece means housed in said contact housing room means of said insulating housing and making elastic contact with said signal contact of said plug on the axis of said contact introducing hole, and an extended piece extended from the base portion of said contact piece means along the inner wall surface of said top panel portion and having a predetermined area;

C) ground socket contact means housed in said contact housing room means of said insulating housing and exposed through said slots made in said side panel portions of said insulating housing for contact with said contact piece means of said ground contact member of said plug; and D) a shield cover electrically connected to said ground socket contact means and having at least a top panel portion covering substantially the entire area of the outer wall surface of said top panel portion of said insulating housing and a rear panel portion covering the back of said insulating housing, said shield cover being disposed opposite said extended piece of said signal socket contact means to form an electrostatic capacitance between it and said signal socket contact means and being connected to a ground conductor of a microstrip line.

5. The receptacle of claim 4 wherein said contact housing room means includes a center signal contact housing room defined by two parallel partition walls extending rearwardly from said front panel portion of said insulating housing and a ground contact housing room at either side of said center signal contact housing room, wherein said signal socket contact means is housed in said signal contact housing room, and wherein said ground contact means has two contact portions coupled together at their base portions and has its two contact portions housed in said two ground contact housing rooms.

6. The receptacle of claim 5 wherein said shield cover further has two terminal portions extended from the lower marginal edge of said rear panel portion and extending in parallel to each other along the underside said insulating housing and in spaced relation to both marginal edges of a signal conductor of said microstrip line, the central portion of said lower marginal edge of said rear panel portion being removed to form an opening astride said signal conductor of said microstrip line, and wherein said signal socket contact means has a signal terminal portion extended from the base portion of said contact piece means and led out through said opening.

* * * * *